US007347078B1

(12) United States Patent
Hopkins et al.

(10) Patent No.: US 7,347,078 B1
(45) Date of Patent: Mar. 25, 2008

(54) RIVET HOLDING CONTAINER AND RIVET FEED SYSTEM FOR AUTOMATIC FEED BLIND RIVET SETTING TOOL

(75) Inventors: James L. Hopkins, Venice, FL (US); Heath Perry, Northport, FL (US)

(73) Assignee: Sartam Industries, Inc., Venice, FL (US)

( * ) Notice: Subject to any disclaimer, the term of this patent is extended or adjusted under 35 U.S.C. 154(b) by 0 days.

(21) Appl. No.: 11/699,235

(22) Filed: Jan. 29, 2007

(51) Int. Cl.
*B21J 15/16* (2006.01)
*B21J 15/32* (2006.01)

(52) U.S. Cl. ..... 72/391.6; 29/243.521; 29/243.525; 29/243.526; 29/812.5; 227/127

(58) Field of Classification Search ..... 72/391.4, 72/391.6, 453.17; 29/243.521, 243.525, 29/243.526, 812.5; 227/127, 157
See application file for complete search history.

(56) References Cited

U.S. PATENT DOCUMENTS 3,886,783 A * 6/1975 Hirsch ..... 29/812.5
4,628,722 A 12/1986 Mauer et al.
4,887,450 A * 12/1989 Gast et al. ..... 29/243.523
5,086,551 A * 2/1992 Shamaly et al. ..... 72/453.17
5,136,873 A 8/1992 Hopkins et al.
5,184,497 A * 2/1993 Hanlon et al. ..... 72/391.6
5,207,085 A * 5/1993 Hopkins et al. ..... 29/812.5
5,351,379 A * 10/1994 Chu ..... 29/243.525
5,651,169 A * 7/1997 Ohuchi et al. ..... 29/243.525
6,163,945 A * 12/2000 Amano et al. ..... 72/391.4

* cited by examiner

*Primary Examiner*—David B Jones
(74) *Attorney, Agent, or Firm*—Charles J. Prescott

(57) ABSTRACT

An elongated rivet bag holding a quantity of blind rivets ready for use in an automatic rivet setting tool. The rivets are connected along an elongated flexible rivet carrying strip by having a distal portion of each mandrel inserted or pierced through the carrying strip and positioned and stored in a random orientation within the rivet bag which is openable at an upper end thereof to render the rivets and strip ready for use. A blind rivet feed device for feeding the rivet-loaded strip into the nose of the automatic rivet setting tool is also provided along with a rivet strip collection bag for the empty strip.

5 Claims, 12 Drawing Sheets

FIG. 9
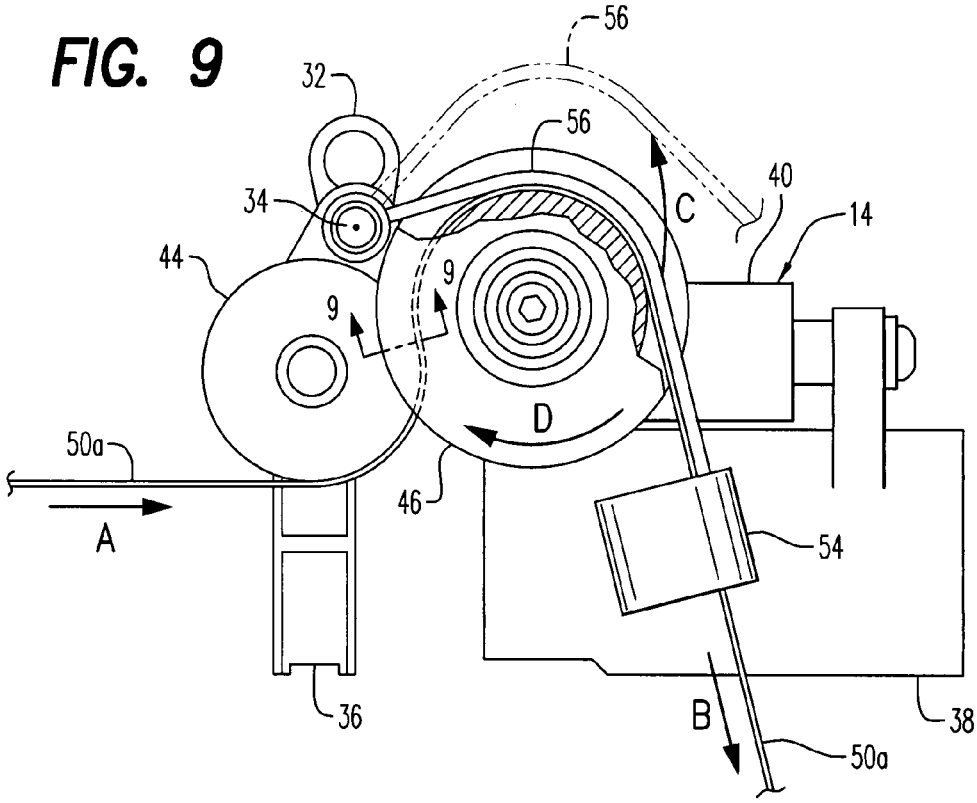
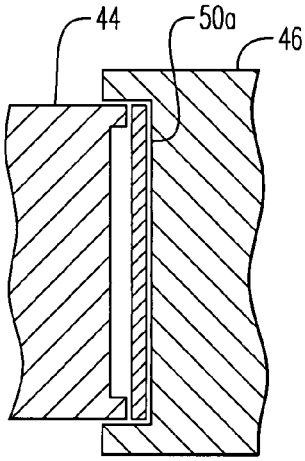
FIG. 9A
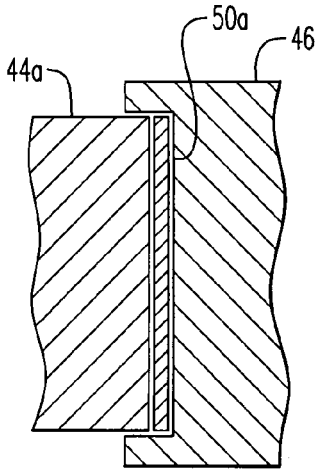
FIG. 9B
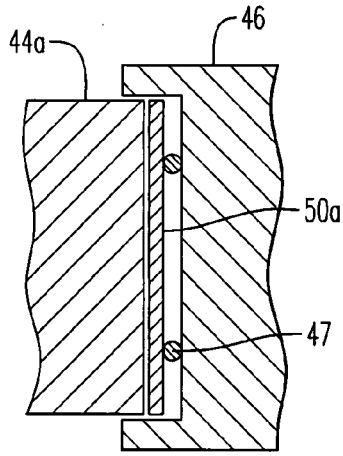
FIG. 9C

RIVET HOLDING CONTAINER AND RIVET FEED SYSTEM FOR AUTOMATIC FEED BLIND RIVET SETTING TOOL

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to automatic riveting devices, and more particularly to a rivet holding container or bag and rivet feed system for an automatic feed blind or pop-rivet setting device.

2. Description of Related Art

Considerable technological effort has been expended in developing blind or pop or mandrel-type rivets, hereinafter collectively referred to as blind rivets, and the associated manually operated devices for setting such rivets. The primary requirement for setting blind rivets is to support the enlarged flange of the rivet body against an anvil or rivet table with the rivet body inserted through a closely mating hole in a work surface. The mandrel extends axially through the rivet table and is gripped by jaws which tension and pull the mandrel rearwardly, expanding the body of the rivet to a point where the mandrel is fractured away. Thus, blind rivets are particularly useful in situations where a conventional riveting tool does not have access to both sides of the working surfaces to be rivet-connected together.

What appears to be a second stage in the development of blind rivets has been toward the automatic setting of the rivet wherein a source of power such as a motor, a pneumatic actuator or hydraulics are utilized to replace manual effort in expanding and setting the rivet through mandrel pull.

This riveting technology has also expanded into the development of automatic riveting devices which include an automatic feed means for the rivets themselves. Prior to such development, the user has been required to manually insert each fresh rivet into the rivet table one at a time. Because these devices still require the user to depress an actuator or trigger to set each rivet, these devices are referred to as "semi-automatic" rivet machines having an automatic feed.

The bulk of these automatic feed rivet devices fall generally into two categories. The first category is one wherein the nosepiece and/or rivet table is pivotally or arcuately connected wherein these components swing apart radially outwardly from one another so that a new rivet may be passed forward longitudinally from behind this arrangement into position, whereupon the nosepiece and/or rivet table components are closed around the rivet body and mandrel with the flange of the rivet against the distal end surface of the rivet table.

The second general category of automatic rivet feed means is directed to an external arm arrangement which swings or pivots a fresh rivet into coaxial alignment forwardly of the rivet anvil and then either automatically draws or allows the rivet to be manually moved rearwardly wherein the mandrel enters the longitudinal aperture of the rivet anvil.

Despite this considerable effort and incentive in developing such an automatic feed rivet setting device, only one such machine has successfully been marketed and is disclosed in U.S. Pat. No. 5,136,873. A rivet magazine is also disclosed in U.S. Pat. No. 5,184,497.

The present invention provides an improved rivet container or bag for compactly holding a large quantity of blind rivets for such a rivet setting tool, which in prototype and pre-production form, has operated successfully and reliably to date. This invention also offers a fully automatic rivet magazine feed system for an accompanying riveter which will set rivets automatically as quickly as an operator can act to position each new rivet head into another hole in the work surface and activate the riveter.

BRIEF SUMMARY OF THE INVENTION

This invention is directed to an elongated rivet bag holding a quantity of blind rivets ready for use in an automatic rivet setting tool. The rivets are connected along an elongated flexible rivet carrying strip by having a distal portion of each mandrel inserted or pierced through the carrying strip and positioned and stored in a random orientation within the rivet bag which is openable at an upper end thereof to render the rivets and strip ready for use. A blind rivet feed device for feeding the rivet-loaded strip into the nose of the automatic rivet setting tool is also provided along with a rivet strip collection bag for the empty strip.

It is therefore an object of this invention to provide an improved container or bag for holding a quantity of rivets for automatic feed into an automatic rivet setting tool for setting blind rivets which includes an automatic rivet feed arrangement.

It is still another object of this invention to provide an improved economically manufactured one-piece container or bag for holding a quantity of rivets as part of an automatic blind rivet feed arrangement for riveting devices.

Still another object of this invention is to provide a uniquely configured automatic rivet feed system which both applies proper tensioning for rivet feed into the nose of an automatic rivet setting tool and also collects or gathers the rivet carrying strip into a separate collection bag for disposal or reuse.

In accordance with these and other objects which will become apparent hereinafter, the instant invention will now be described with reference to the accompanying drawings.

BRIEF DESCRIPTION OF THE SEVERAL VIEWS OF THE DRAWING(S)

FIG. 9 is a side elevation broken view of the rivet feed system of the invention.

FIGS. 9A, 9B and 9C are section views of alternate embodiments in the direction of arrows 9-9 in FIG. 9.

DETAILED DESCRIPTION OF THE INVENTION

Prior Art

Figure 1:
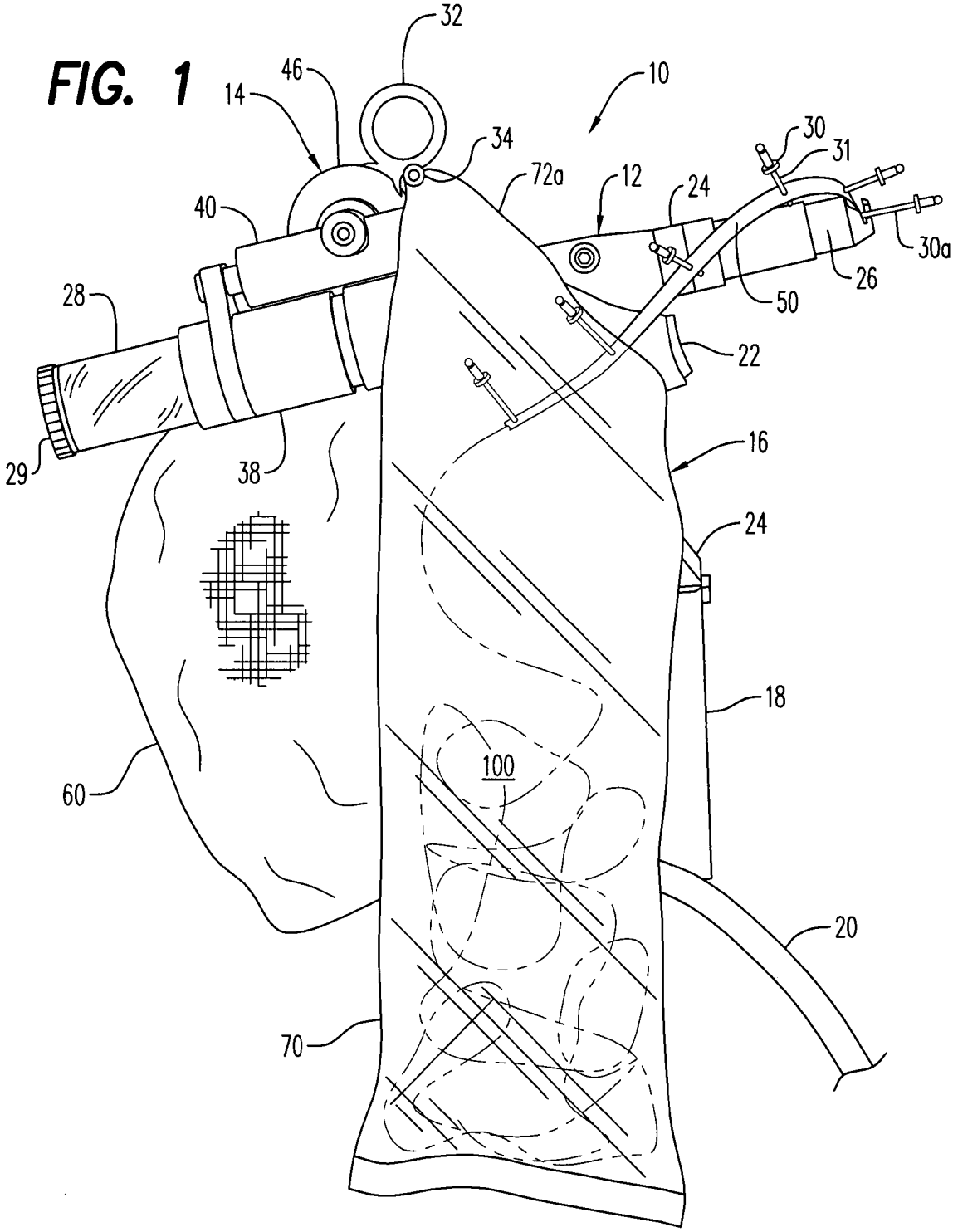
FIG. 1 is a right side elevation view of the invention attached to a semi-automatic rivet setting tool.
Figure 2:
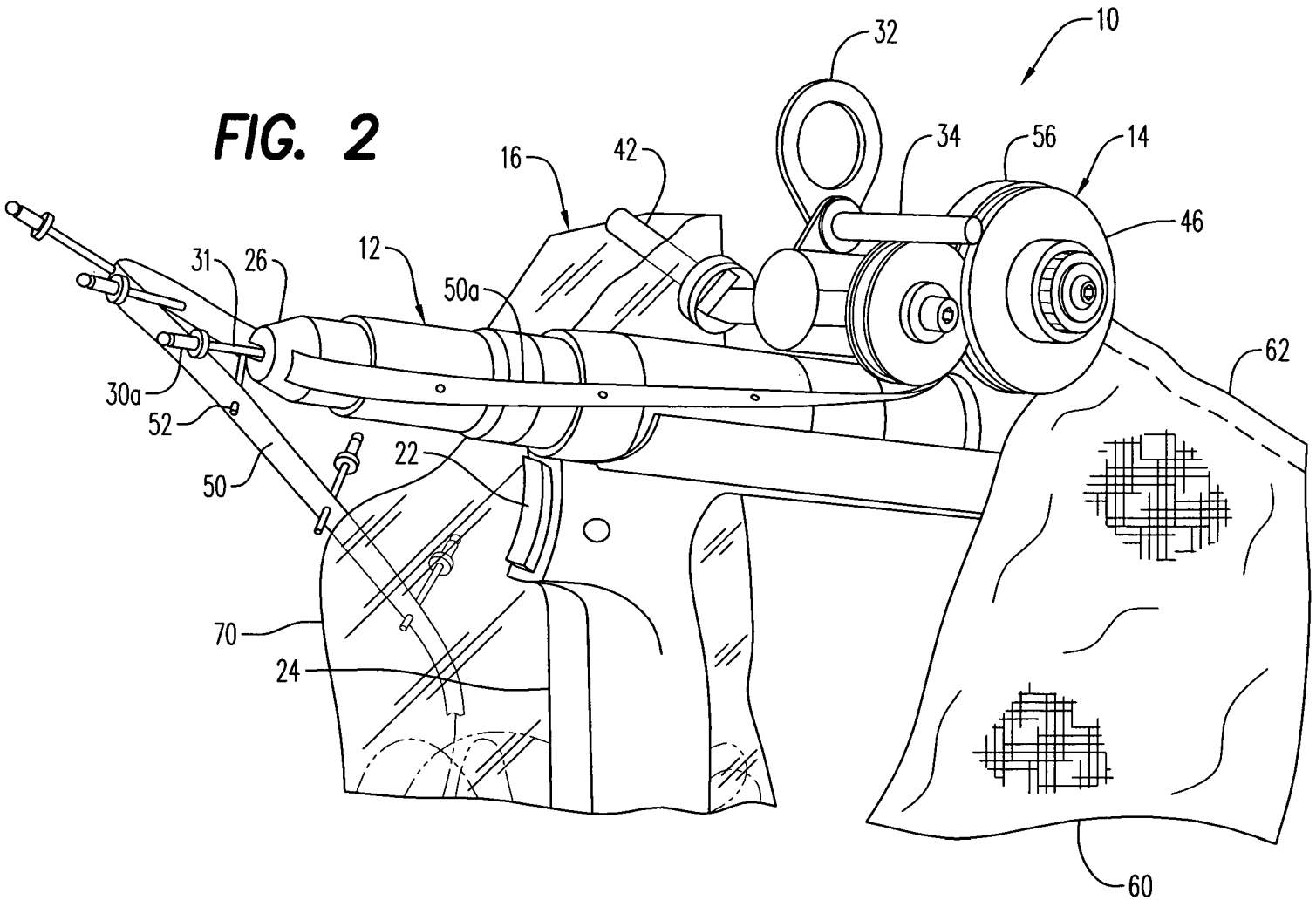
FIG. 2 is a left side perspective view of FIG. 1.
Figure 3:
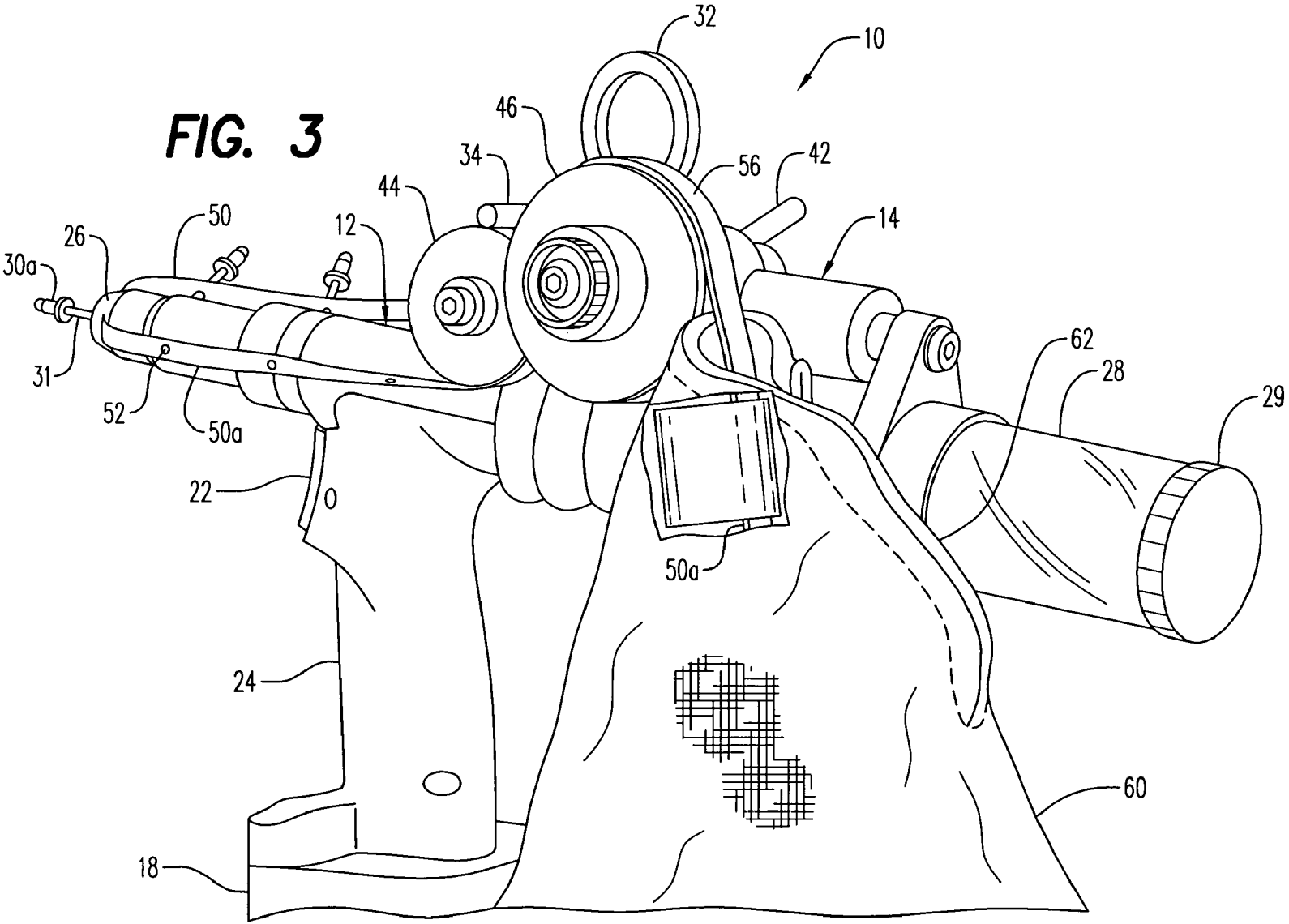
FIG. 3 is an enlarged left side broken perspective view of FIG. 1.
Figure 4:
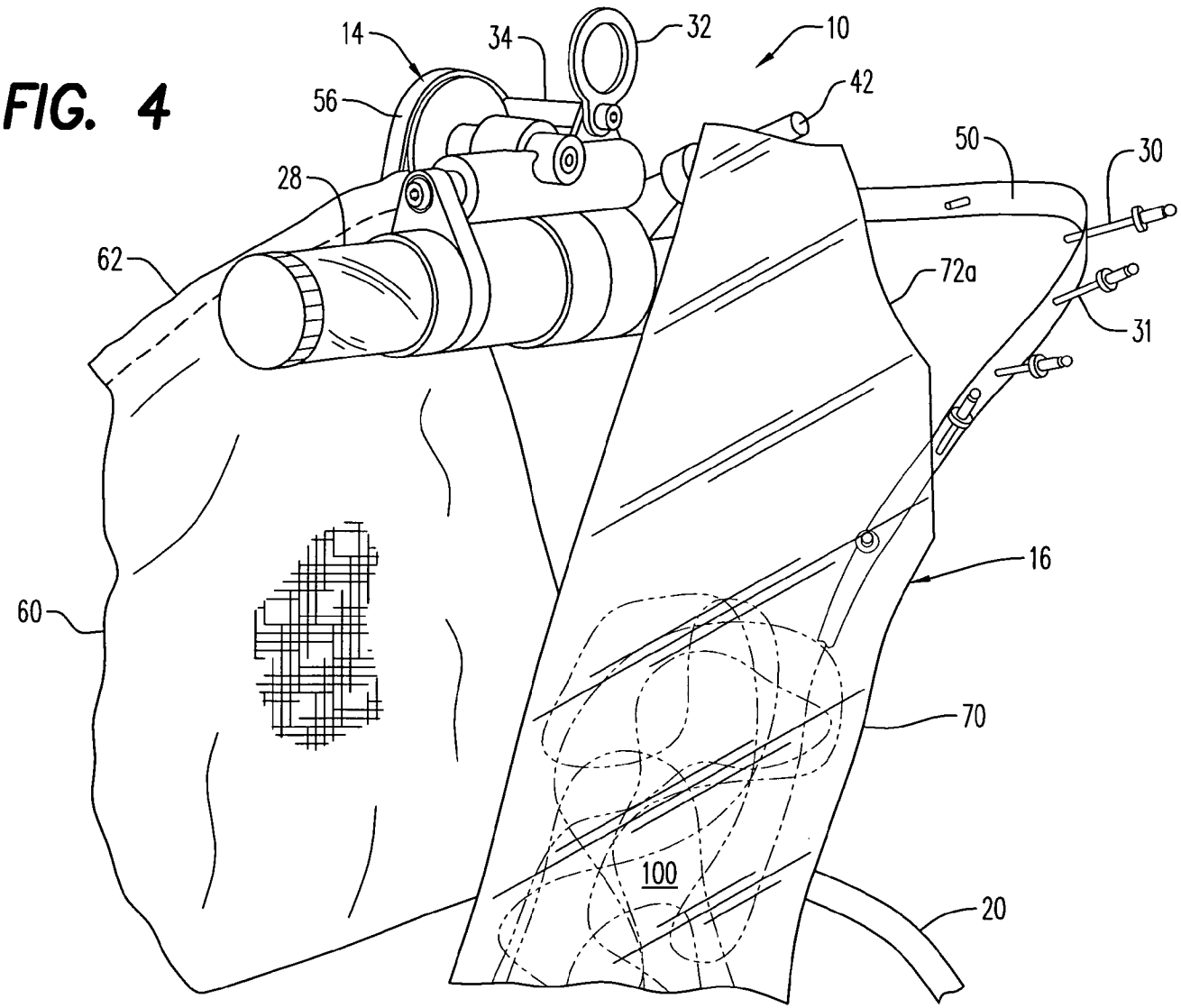
FIG. 4 is a right side perspective view of FIG. 1.
Figure 5:
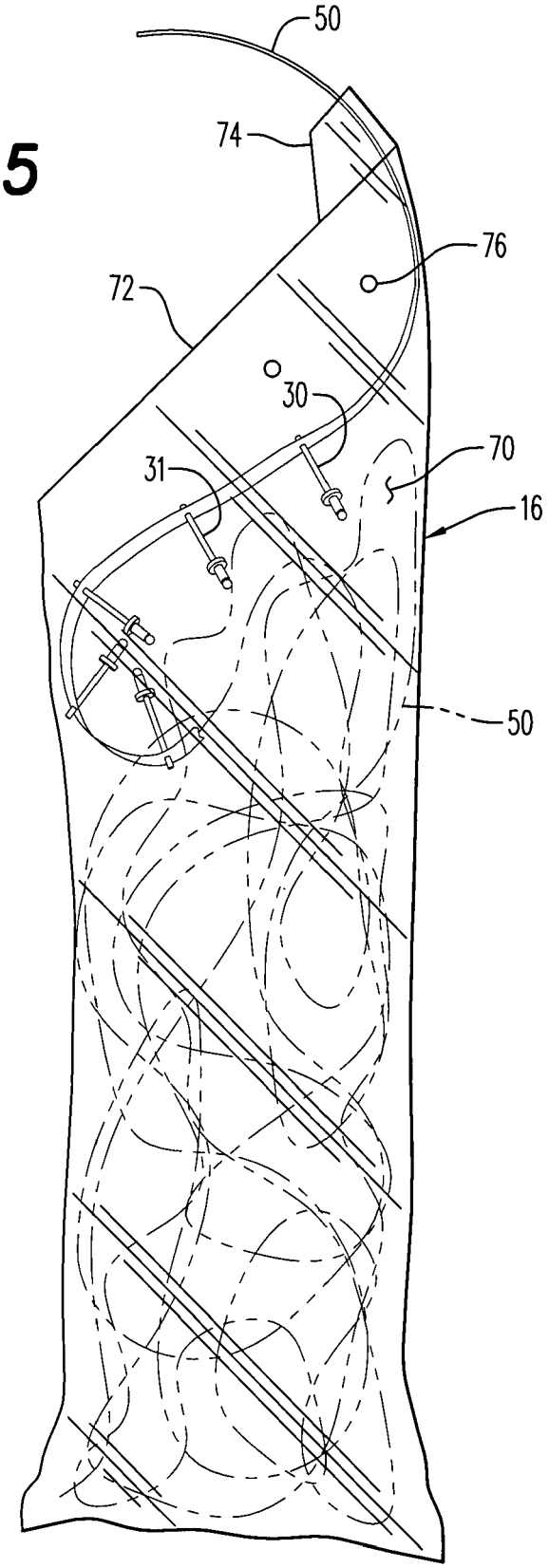
FIG. 5 is a side elevation view of an elongated rivet container or bag filled with blind rivets attached to a flexible carrying strip.
Figure 6:
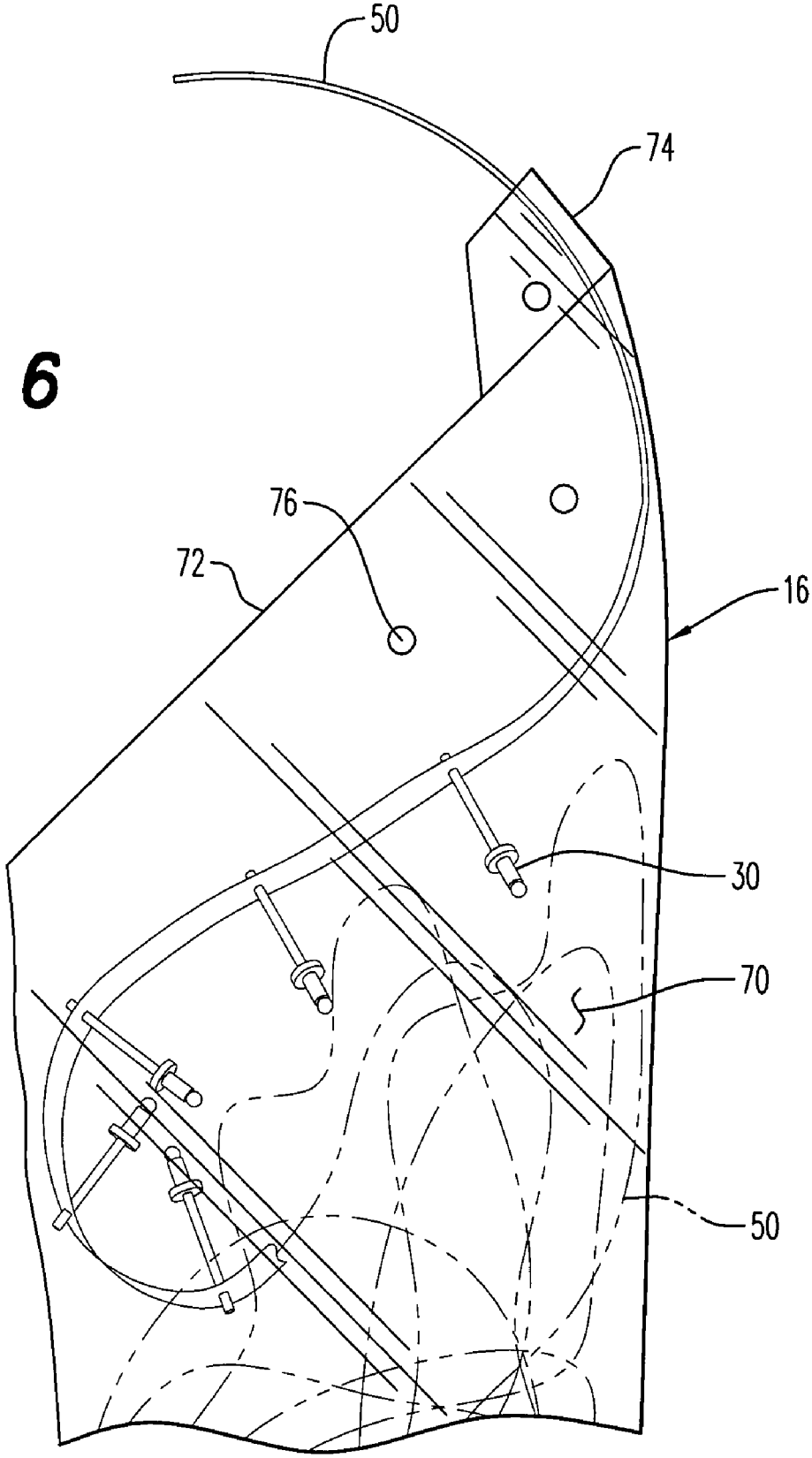
FIG. 6 is an enlarged view of the upper portion of FIG. 5.
Figure 7:
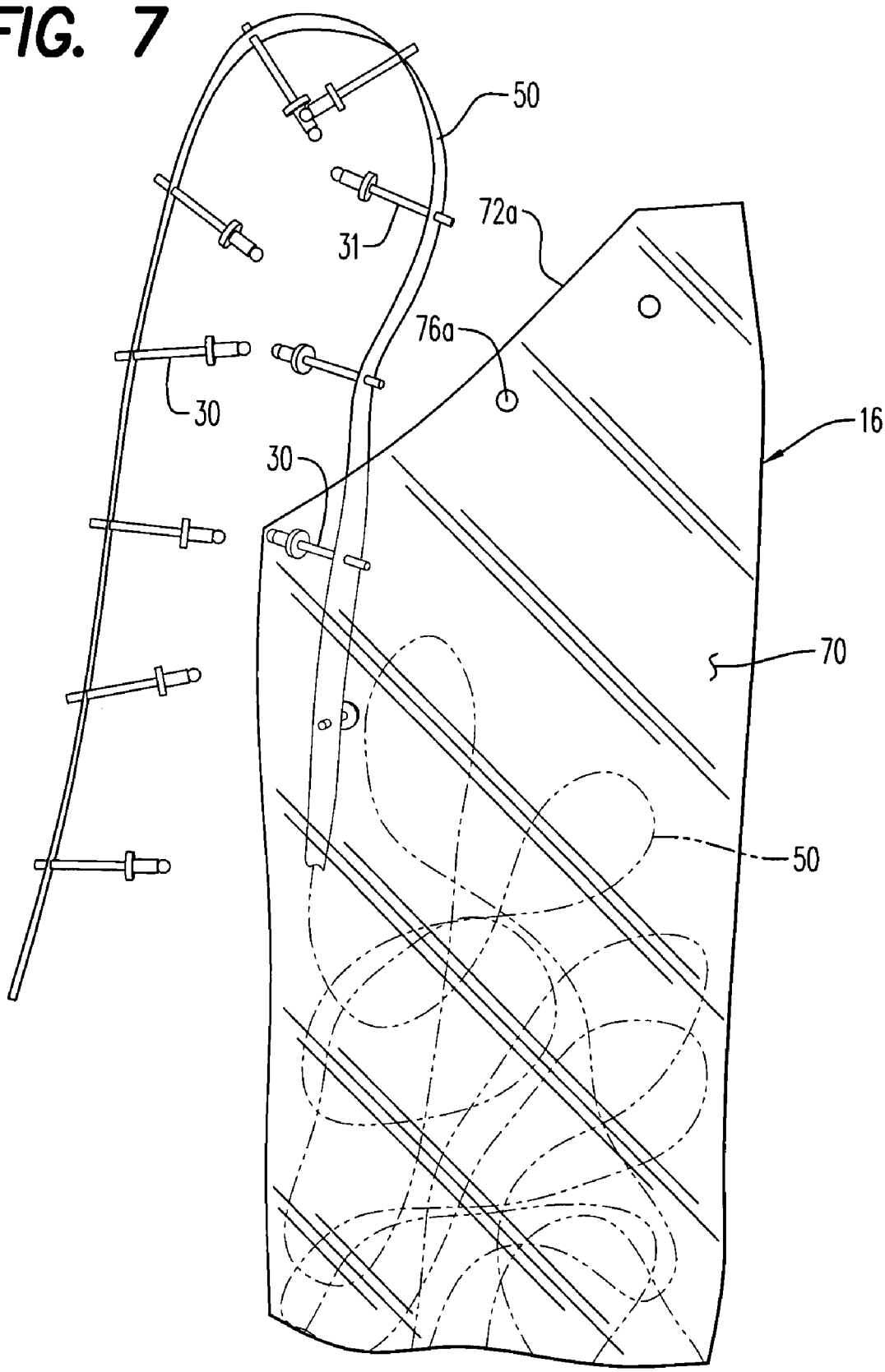
FIG. 7 is a view of FIG. 6 showing the upper open end of the bag assembly opened and ready for use.
Figure 8:
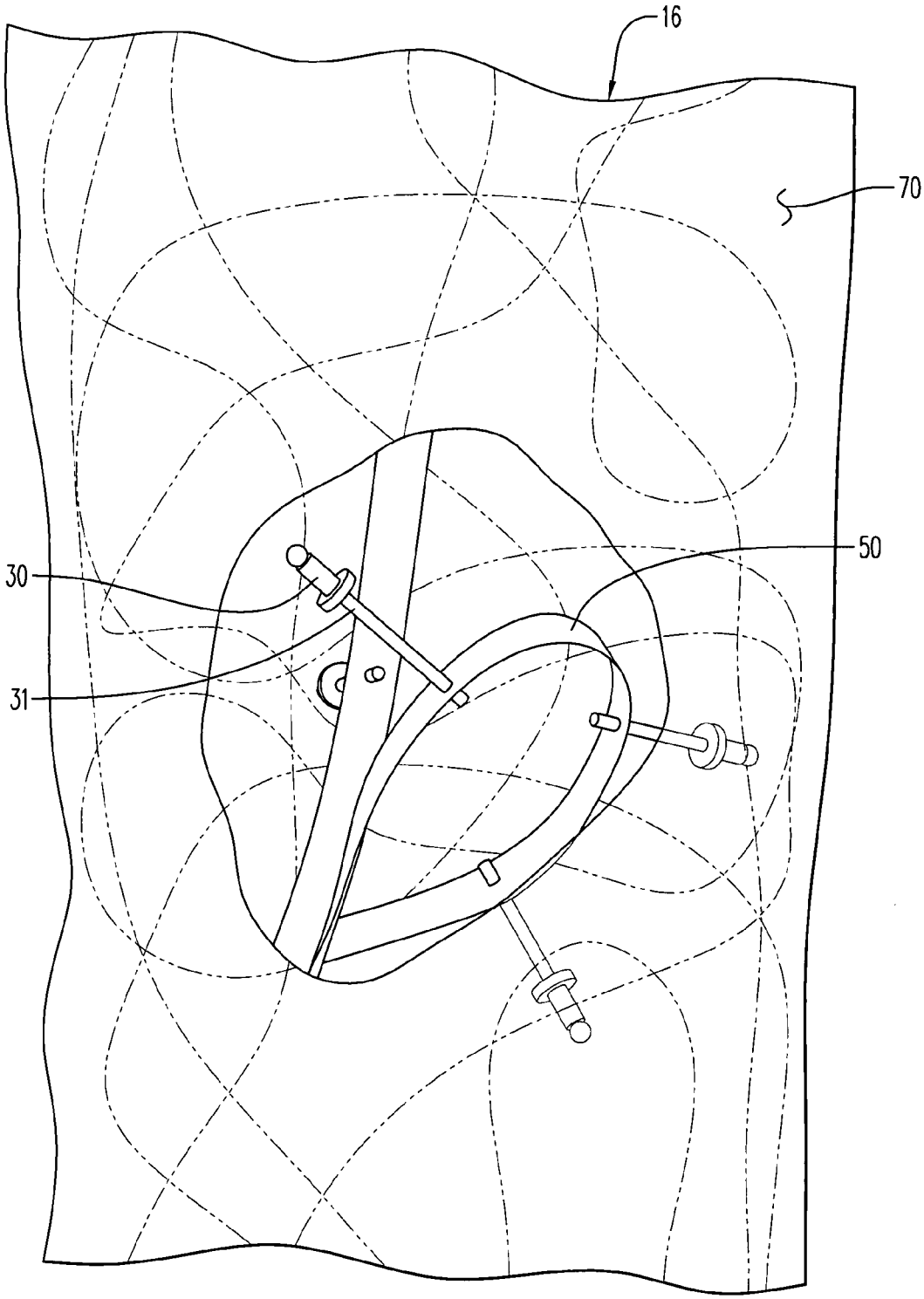
FIG. 8 is an enlarged broken view of the central portion of FIG. 6.

The complete specification and drawings disclosed in U.S. Pat. Nos. 5,136,873, 5,184,497 and 5,206,085 all of which are owned by the assignee of this application, are incorporated herein by reference and are repeated herein.

Referring now to the drawings, and firstly to FIGS. 1 to 4, a semi-automatic rivet setting tool as disclosed in the referenced patents is there shown generally at numeral 12 as a support element of the overall invention shown generally at numeral 10. The rivet setting tool 12 includes a main housing 24 and an attached pneumatic pressure tank 18 with pressurized air feed line 20 connected thereto. The housing 24 includes an actuation trigger 22 which controls the internal operation of the tool 12 to fracture the mandrel 36 of each pop rivet 30*a* introduced into the nosepiece 26, the rivet setting mechanism as described in the referenced patents.

The invention 10 further includes a rivet feed system 14 and a container or bag 16 filled with rivets 30 attached to an elongated strip of flexible plastic or MYLAR carrying a quantity of rivets 30 in evenly spaced relation therealong. The distal end portion of each of the mandrels 31 of each rivet 30 is pierced through the flexible plastic strip 50 which is of sufficient strength and resiliency to retain the tip portion of each of the rivets 50 in the position shown until such time as the carrying strip 50 delivers each rivet 30 successively into the transverse slot formed into the nosepiece 26 of the rivet setting tool 12. For clarity, each rivet is generally referred to at numeral 30 while the particular rivet shown in position within the nosepiece 26 is referred to as 30*a*. Further, the portion of the carrying strip 50 loaded with rivets prior to entering the nosepiece 26 is referred to at numeral 50 while the portion of the carrying strip which no longer contains rivets is referred to as 50*a*.

Referring particularly to FIGS. 5, 6, 7 and 8, a rivet magazine in the form of an elongated flexible transparent rivet bag is there shown generally at numeral 16 formed of an elongated thin flexible sheet plastic material into a bag 70 wherein the sides and bottom thereof are sealed. A length of rivet strip 50 loaded with rivets 30 as above described is filled into the open upper end 72 of the bag 70 by simply allowing gravity to randomly wind and stack the elongated loaded carrying strip starting at the bottom of the bag and working upwardly. Vibration during this loading process facilitates more dense nesting of the loaded rivet strip 50 into the bag 70, after which the open upper end is folded over at 72 and heat sealed at 76 best seen in FIG. 6. The upper free end of the MYLAR carrying strip 50 extends from a small open portion 74 to facilitate opening of the sealed bag 70 after which it is hung on spindle 42 shown in FIGS. 1 to 4. This spindle 42 is provided to support another embodiment of a conventional plastic magazine not directly associated with the present invention.

Note that the length and width of the bag 70 may vary and hold smaller and substantially larger quantities of rivets 30 depending upon the practical needs of the rivet setting tool 12. In a production setting, the disposable bag 70 may be elongated and widened to hold as many as upwards of 1000 rivets compactly within this packaging concept.

Figure 10:
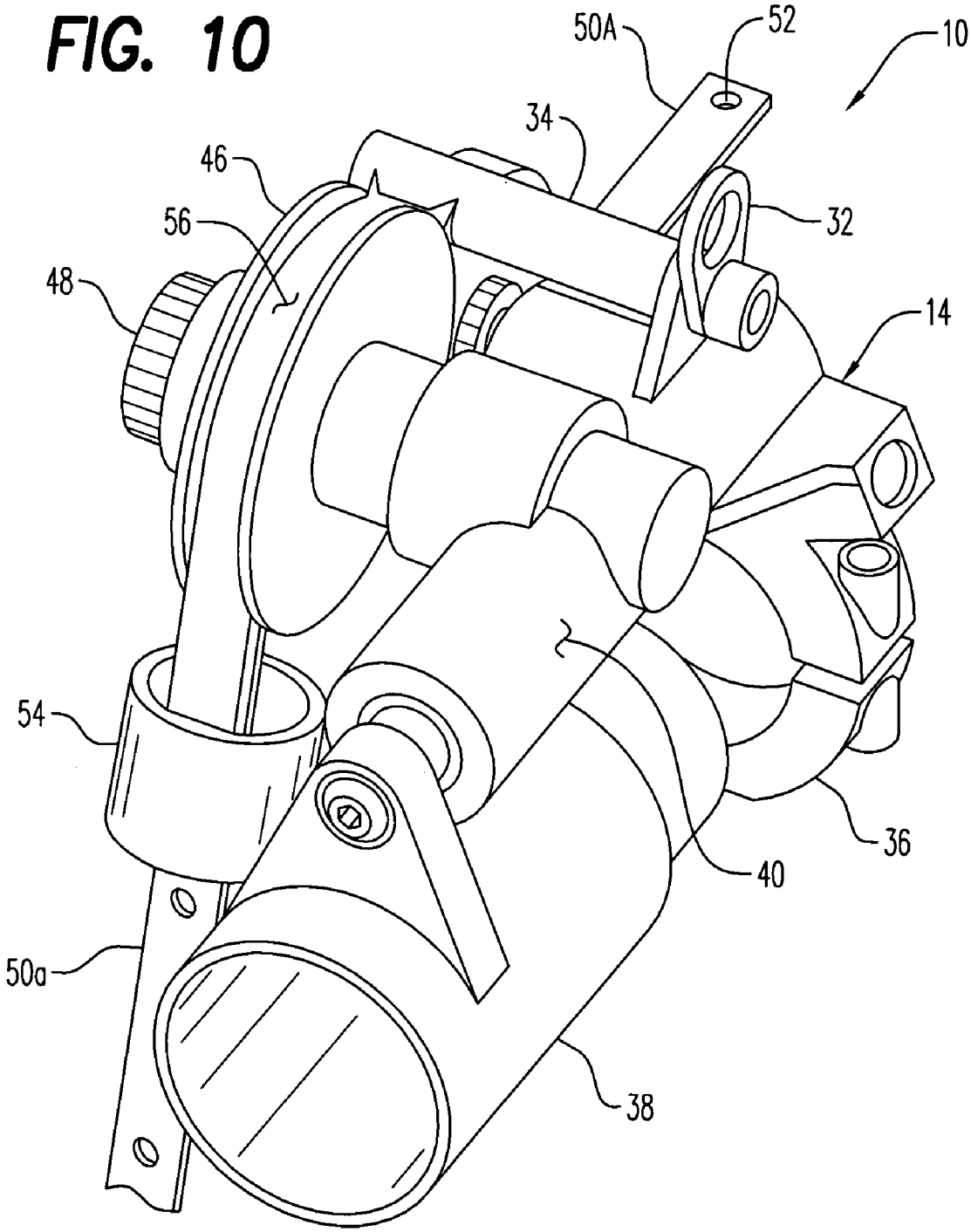
FIG. 10 is a rear perspective view of FIG. 9.
Figure 11:
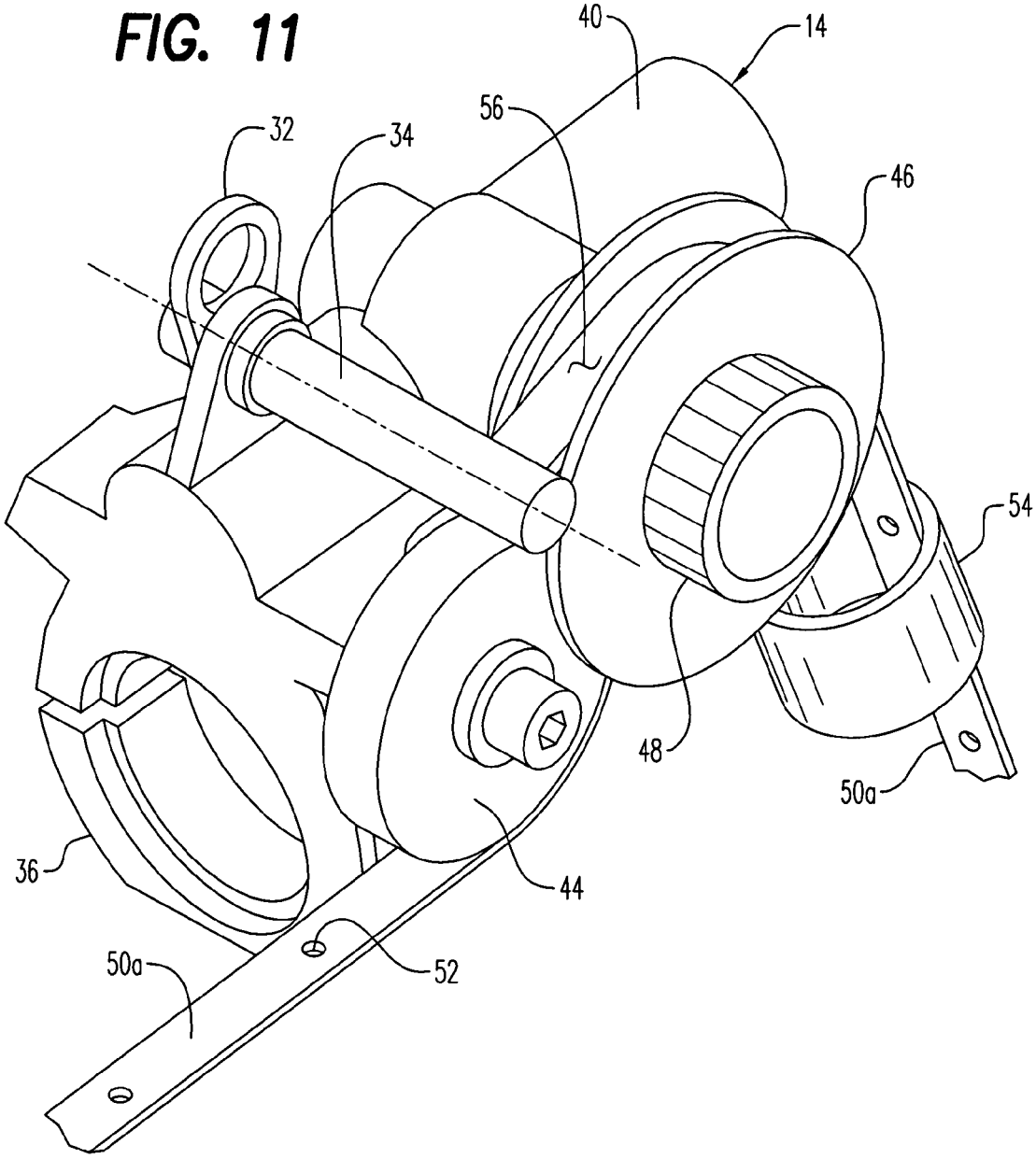
FIG. 11 is a front perspective view of FIG. 9.

Once the loaded rivet bag 16 is opened by tearing heat seals at 76 and properly supported on spindle 42 of the rivet setting tool 12, the upper exposed distal end portion of the carrying strip 50 is fed through the nosepiece 26 and pulled until one of the rivets 30*a* has engaged into the nosepiece. The end of the carrying strip 50 is then drawn rearwardly into the rivet feed mechanism 14 as best seen in FIGS. 9 to 11. The rivet feed mechanism 14 includes a tubular body 38 which interconnects with the main body 24 of the rivet setting tool 12. A tightenable clamp 36 secures the rivet feed mechanism 14 directly to and in alignment with the main body 24 of tool 12. A pneumatic motor 40, also actuated through internal air passages to the pneumatic pressure tank 18, is interconnected to rotate a second drive wheel 46 in the direction of arrow D in FIG. 9. A tension adjust knob 48 controls the amount of clutch action or slippage to produce an appropriate amount of tensioning of the carrying strip 50/50*a* as will be described herebelow.

A first drive wheel 44 is fitted within the outer flanges of the second drive wheel 46 and is oriented elevation-wise so that the respective axes of these drive wheels 44 and 46 cause the carrying strip 50*a* to wind between the perimeters of these drive wheels 44 and 46 as best seen in FIG. 9. An arcuate retainer member 56, pivotally connected to shaft 34, opens in the direction of arrow C in FIG. 9 and is tensionable against the carrying strip 50*a* as shown in solid in FIG. 9. By this arrangement, as the second drive wheel 46 is rotated in the direction of arrow D, an appropriate amount of tensioning causes the carrying strip 50*a* to be drawn in the direction of arrow A between and through the drive rollers 44 and 46 to draw the loaded portion of the carrying strip 50 through the nosepiece 26 to successively deliver each rivet 30*a* one at a time as the previously positioned rivet is set. Thus, the rivet feed into the nosepiece 26 as described in the referenced patents is fully automatic, greatly increasing the speed at which rivets may be successively set.

A carrying strip collection bag 60 as best seen in FIGS. 1 to 4 is releasably attached to a support collar 54 which is connected to the distal end of the retainer member 56. This tubular collar 54 is engageable within the open upper end 62 of collection bag 60 by internal elastic tensioning means or a drawstring. The portion of the empty carrying strip 50*a* discharging in the direction of arrow B through the collar 54 is guided into the collection bag 70 and self winds to compact and store the carrying strip 50*a* for convenient reuse or disposal.

Note in FIGS. 9A, 9B and 9C, various embodiments are provided to insure proper tensioning and feed of the MYLAR carrying strip 50*a* therethrough. The preferred embodiment in FIG. 9C includes elastomeric O-rings 47 which are stretched and positioned around the inner hub of drive wheel 46. Because these elastomeric O-rings 47 are easily replaceable when worn, service to insure smooth tensioning and feed of the carrying strip 50*a* through the feed mechanism system 14 is insured.

A mandrel collection container 28 in the form of a transparent cylindrical tubular member is connectable to the rear end of the housing 38. Rather than discharge spent mandrels 31 onto the ground after each successive rivet has been set, the mandrels 31 travel through the tubular body of the main housing 24 and the feed housing 38 into the mandrel container 28 for collection and disposal. A threaded cap 29 facilitates emptying of this mandrel container 28 when visually filled.

Figure 12:
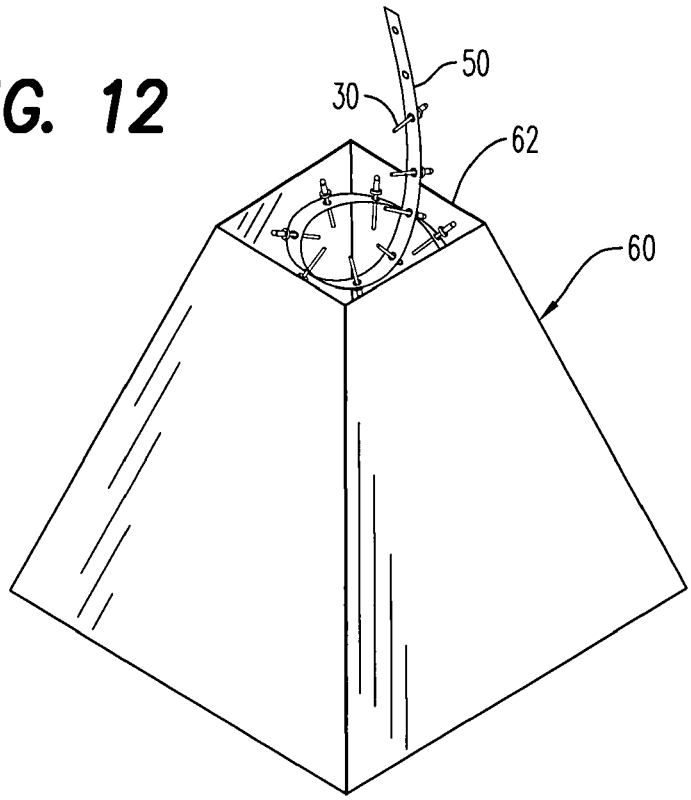
FIG. 12 is a perspective view of another embodiment of an enlarged rivet container filled with a larger quantity of blind rivets attached to a flexible carrying strip.
Figure 13:
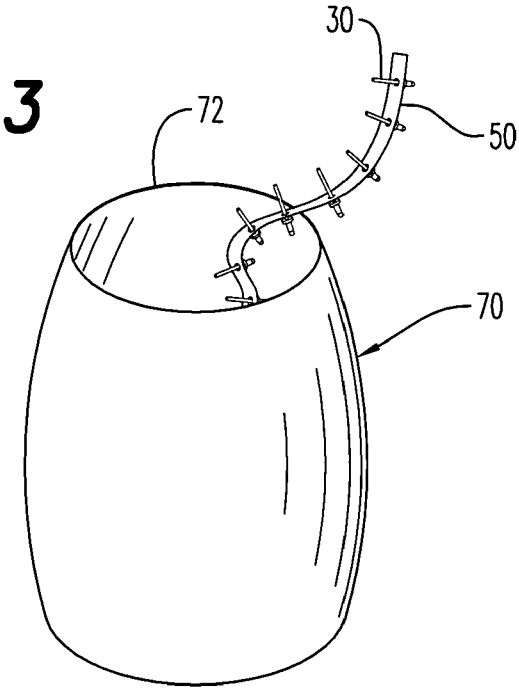
FIG. 13 is yet another embodiment of a rivet container also filled with blind rivets attached to a flexible carrying strip.

In FIG. 12, another embodiment of the rivet container is there shown generally at numeral 60 holding a quantity of rivets 30 attached to a flexible strip 50. In this embodiment 60, in the form of a truncated pyramid, the opening 62 is smaller than the base to facilitate steady and controlled removal of the rivet strip 50 as the rivets are installed. In FIG. 13, another embodiment of the rivet container is there shown generally at numeral 70 in the form of a barrel. The opening 72 is slightly reduced in size from that of the lower portion of the container 70, again to facilitate rivet strip 50 removal as the rivets 30 are consumed.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A container holding a quantity of blind rivets ready for use in an automatic rivet setting tool, comprising:

an elongated rivet bag releasably closed at an upper end thereof for storage and dependently connectable at said upper end to an elongated laterally extending spindle of the rivet setting tool;

said rivets being connected in spaced relation along the length of an elongated flexible rivet carrying strip by having a distal portion of each mandrel inserted or pierced through said carrying strip;

said rivets on said carrying strip being positioned in a random orientation within said rivet bag with one end of said carrying strip being positioned at or adjacent to a lower end of said rivet bag while another end of said carrying strip is positioned immediately adjacent to and within or extending from said upper end of said rivet bag.

2. A blind rivet storage and feed system for an automatic rivet setting tool, comprising:

an elongated strip of thin flexible material having a lead end and a plurality of blind rivets connected in spaced apart relation along the length of said flexible strip by having at least the distal portion of each mandrel pierced through and retained within said flexible strip;

said flexible strip slidably extending through a transverse feed slot formed through a rivet table of the rivet setting tool, the feed slot orthogonally intersecting a longitudinal mandrel receiving slot extending laterally in one direction from a rivet table aperture to an outer surface of the rivet table;

a feed device attached to the tool and being engagable with a lead end portion of said flexible strip for pulling said flexible strip through the transverse slot to draw each mandrel of each blind rivet held in said flexible strip and positioned immediately adjacent the rivet table one at a time into the rivet table aperture through the mandrel receiving slot;

an elongated rivet bag releasably closed at an upper end thereof for storage and dependently connectable at said upper end to an elongated laterally extending spindle of the too;

said rivets on said carrying strip being positioned in a random orientation within said rivet bag with one end of said carrying strip being positioned at or adjacent to a lower end of said bag while said lead end portion is positioned immediately adjacent to and within or extending from said upper end of said rivet bag.

3. A blind rivet feed system for an automatic rivet setting tool, the tool utilizing a continuous rivet delivery arrangement including an elongated strip of thin flexible material having a lead end and a plurality of blind rivets connected in spaced apart relation along the length of said flexible strip by having at least the distal portion of each mandrel pierced through and retained within said flexible strip, the flexible strip slidably extending through a transverse feed slot formed through a rivet table of the rivet setting tool, the feed slot orthogonally intersecting a longitudinal mandrel receiving slot extending laterally in one direction from a rivet table aperture to an outer surface of the rivet table, said feed system comprising:

a feed device attached or attachable to the tool and being pullably engagable with a lead end portion of said flexible strip for pulling said flexible strip through the transverse slot to draw each mandrel of each blind rivet held in said flexible strip and positioned immediately adjacent the rivet table one at a time into the rivet table aperture through the mandrel receiving slot;

a carrying strip collection bag positioned downstream of, and in alignment with, a flexible strip discharge area of said feed device wherein said flexible strip without blind rivets is fed into said collection bag.

4. A blind rivet feed system as set forth in claim 3, wherein said feed device includes:

first and second wheels having closely interengaging perimeters and arranged in edge-to-edge fashion to drivingly engage with said carrying strip passing therebetween wherein said carrying strip is tensioned and pulled through and from the rivet table as said wheels are rotated.

5. A blind rivet feed system as set forth in claim 4, further providing:

a removable mandrel collection container releasably attached to a rear portion of said feed device for safely collecting mandrels after being fractured as each blind rivet is set by said tool.

* * * * *